United States Patent [19]

Turley

[11] 4,045,307

[45] Aug. 30, 1977

[54] STRUCTURE FOR SWITCHING ELECTRICAL CURRENT AND CELL COMPRISING SAME

[75] Inventor: Bernard C. Turley, Pittsburgh, Pa.

[73] Assignee: Aluminum Company of America, Pittsburgh, Pa.

[21] Appl. No.: 648,903

[22] Filed: Jan. 14, 1976

[51] Int. Cl.[2] ..... C25C 3/00

[52] U.S. Cl. ..... 204/64; 204/243 M; 200/1 V; 200/228

[58] Field of Search ..... 200/1 V; 204/64, 67, 204/242, 243, 244

[56] References Cited

U.S. PATENT DOCUMENTS 3,703,621 11/1972 Viola ..... 200/1 V 3,822,195 7/1974 Dell et al. ..... 204/64

*Primary Examiner*—John H. Mack
*Assistant Examiner*—H. A. Feeley
*Attorney, Agent, or Firm*—Elroy Strickland

[57] ABSTRACT

A structure for switching electrical current, the structure comprising a switch having two pairs of terminals and two modes of operation. The structure, in addition, includes a first electrically conductive means for connecting the terminals of one pair together, and, a second electrically conductive means for connecting the terminals of the other pair together. Means are included for disconnecting the terminals of the above pairs, and a third electrically conductive means is provided for connecting one of the terminals of one pair to one of the terminals of the other pair.

5 Claims, 6 Drawing Figures

STRUCTURE FOR SWITCHING ELECTRICAL CURRENT AND CELL COMPRISING SAME

BACKGROUND OF THE INVENTION

The present invention relates generally to a structure for switching electrical current, and to a switching structure that is particularly suitable for changing the direction of current flow in a large electrolytic cell, though the invention is not limited thereto.

In the operation of electrolytic cells, for example, a cell adapted to produce aluminum by electrolysis of alumina disposed in a fused salt bath, before the alumina and bath are placed in the cell, the cell is usually preheated to a predetermined, operating temperature. Heretofore, this has been accomplished by a variety of ways, one of which has been the use of resistant heaters located in the cell or in the walls of the cell, such as shown in DeVarde U.S. Pat. No. 2,959,528. In addition, the DeVarda patent discloses the use of a certain level of preheated molten metal located between electrodes located vertically in the cell and conducting current through the electrodes and molten metal as a means to preheat the cell, the interface of the molten metal and the electrodes being somewhat resistent to the flow of current.

In Tilson U.S. Pat. No. 1,572,253, a Hall cell is preheated by lowering the anodes of the cell into physical contact with the cathode liner thereof, and applying direct current across the anodes and liner, the interface of the anodes and liner being resistant to the flow of current such that the liner and cell are heated.

In DeVarda U.S. Pat. No. 3,382,166 there is shown a two-stage heating process for a multicell furnace having a large plurality of electrodes suspended vertically in the furnace and a corresponding plurality of verticaly extending bars. The second stage of the two-stage process involves connecting each two adjacent bars together, with a conductive latch or bar, in a series or parallel arrangement. Current is then directed through the electrodes to preheat the cell. After an appropriate temperature is reached, each connecting bar or latch is removed to return the cell to an operating, metal-producing condition.

BRIEF SUMMARY OF THE INVENTION

The present invention is directed to a highly convenient, inexpensive switch means for changing the operation of multi-electrode electrolytic cell or other electrical load device. This is accomplished by the use of one switch arrangement for the cell or other load device, the switch arrangement comprising two pairs of terminals, the terminals being physically close to but spaced from each other. A first electrically conductive means is provided for connecting the terminals of one pair together, and a second electrically conductive means is provided for connecting the terminals of the other pair together. If the load is an electrolytic cell, this arrangement connects all of the anodes and the cathodes of the cell respectively to positive and negative terminals of a power supply so that current is directed through the cell for the purpose of producing metal. To preheat the cell or to place the cell in a standby (heated) condition, the conductive means are moved away from the terminal pairs to disconnect the same, and a third conductive means is disposed to connect one of the terminals of one pair to one of the terminals of the other pair. This places the cathodes and anodes of the cell in electrical series with the power supply so that the inherent resistance of the anodes and cathodes can be employed to generate and maintain heat within the cell.

THE DRAWINGS

The invention, along with its advantages and objectives, will be best understood from the following detailed description when considered in connection with the accompanying drawings in which.

PREFERRED EMBODIMENT OF THE INVENTION

Figure 1:
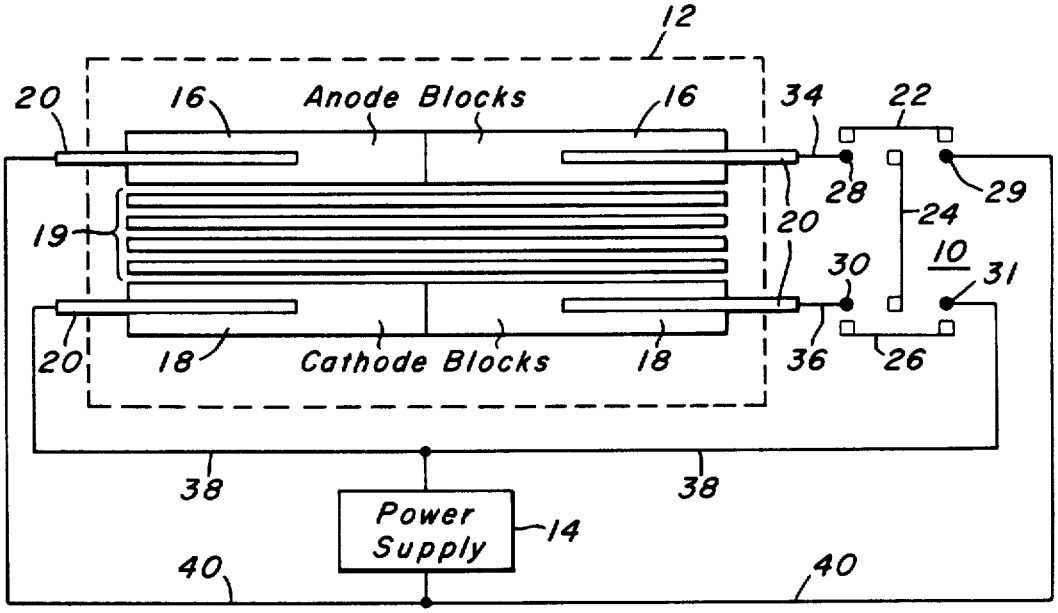
FIG. 1 is a schematic diagram of a switching device constructed in accordance with the principles of the present invention, and an electrolytic cell connected in the circuit of the switch.
Figure 2:
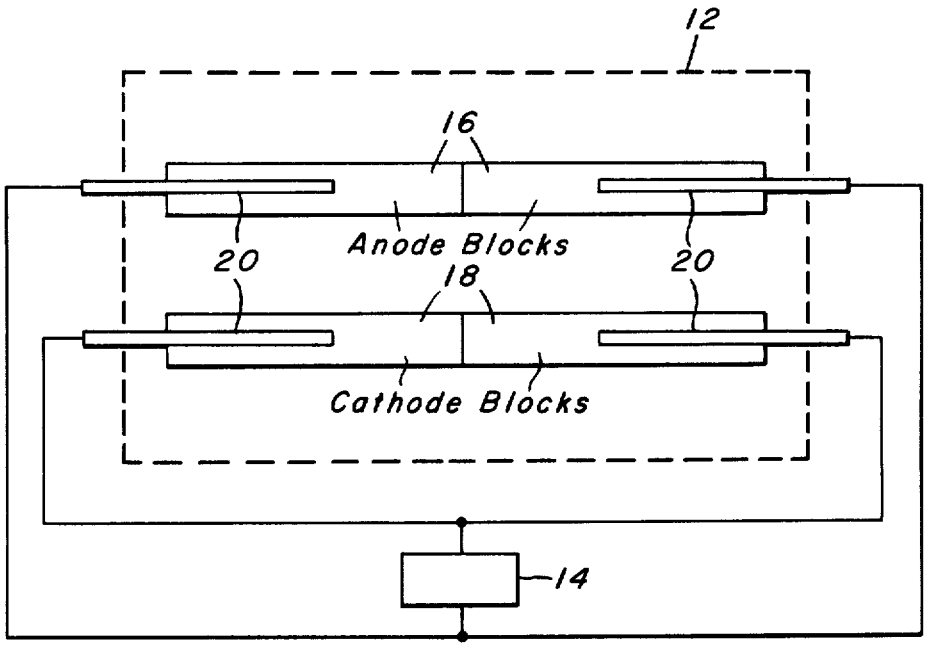
FIG. 2 is a schematic diagram of an electrolysis cell electrically connected to a source of electrical current for normal operation of the cell.
Figure 3:
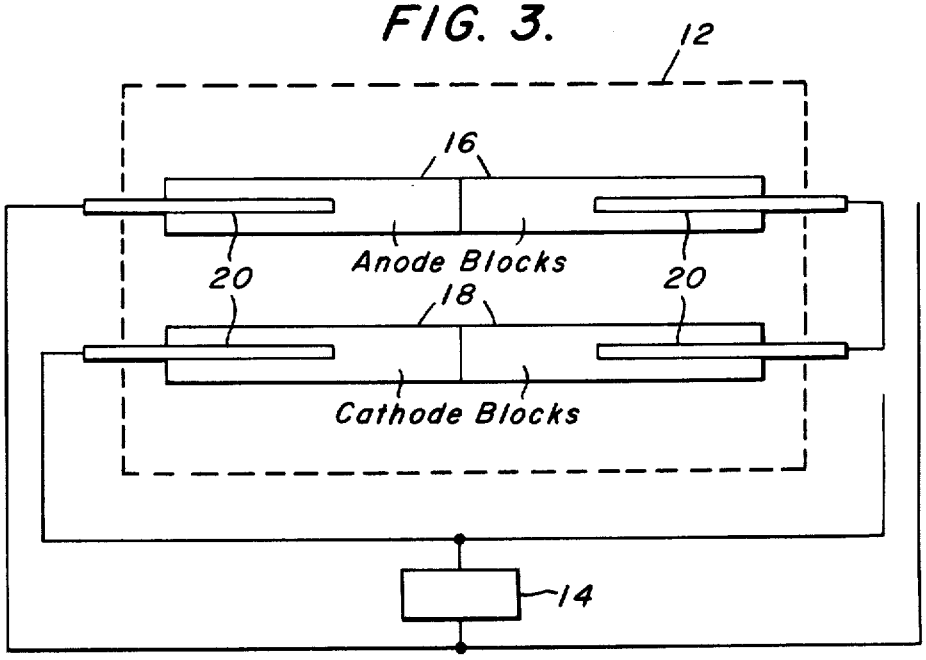
FIG. 3 is a schematic diagram of the cell of FIG. 2 connected to the current source in a manner that places the cell in a preheat or standby condition.

Referring now to the drawings, FIG. 1 thereof shows schematically a switch 10 constructed in accordance with the invention, the switch having two modes of operation, one of which is adapted to connect an electrical load, such as the molten bath of an electrolytic or electrolysis cell 12 to a power supply 14, in a manner that places the cell in ordinary operation, as shown in FIG. 2. The second mode of switch and cell operation is indicated in FIG. 3, in which the anodes and cathodes (16 and 18) are placed in electrical series with the supply. Current now flows serially through the anodes and cathodes, and is sufficient to heat the cell for preheat or stand-by purposes.

Parenthetically, as depicted in FIGS. 1 to 3, the cell 12 has two abutting anode members or blocks 16 and two abutting cathode blocks 18, with opposed conductors or leads 20 extending partway into the ends of the blocks through opposed walls (only diagrammatically shown in dash outline in FIGS. 1 to 3) of the cell. The anode blocks may be located vertically above the cathode blocks, with bipolar electrodes 19 (FIG. 1) vertically stacked between the anode and cathode blocks, through the invention is not limited thereto. The detailes of a bipolar cell are shown and described in U.S. Dell et al Pat. 3,822,195 issued on July, 2, 1974.

As shown schematically in FIG. 1 of the drawings, switch 10 of the invention comprises three members 22, 24 and 26, made of highly conductive material, such as copper or an electrical grade aluminum, and adapted to be moved into and out of contact with terminals 28 to 31, terminals 28 and 29 forming one pair of terminals for anodes 16, and terminals 30 and 31 providing a pair of terminals for cathodes 18. As shown further in FIG. 1, terminals 28 and 30 are connected respectively directly to bars 20 on one side of cell 12, while terminals 29 and 31 are connected to the terminals of power supply 14. The anode and cathode bars 20 on the other side of the cell are shown connected to the same respective terminals of the power supply as terminals 28 and 30. In terms of an electrolytic cell for the production of aluminum, for example, and in the embodiment shown in FIGS. 4 to 6 of the drawings, the means (lines 34, 36, 38 and 40) connecting terminals 28 to 31 to the power supply would be heavy buses and the members 22, 24 and 26 would be relatively thick plate-like structure, as explained hereinafter. In addition, for the operation of a metal-producing cell, the power supply is a direct current (DC) source having a positive terminal connected to anodes 16, and a negative terminal connected to cathodes 18.

From FIG. 1 it can be appreciated that switch 10 is able to connect cell 12 across power supply 14 for metalproduction by simply moving conductive members 22 and 26 into respective electrical contact with terminal pairs 28, 29 and 30, 31 and maintaining conductive member 24 out of contact with the terminals. In this manner, current flows between anodes 16 and cathodes 18 through the bipolar electrodes 19 and through the electrolytic bath and metal within the cell.

On the other hand, to place cell 12 in a preheat or stand-by condition, conductive members 22 and 26 are moved away from their associated terminal pairs, and conductive member 24 moves into electrical contact with terminals 28 and 30. Such an electrical configuration is shown in FIG. 3. With this configuration, bath and metal (if any) within cell 12, and the bipolar electrodes 19, are removed from the circuit of the power supply, and the anodes and cathodes placed serially in the circuit of the power supply. Current flow is now limited to a path through the anodes and cathodes, the electrical resistance of which is sufficient to heat or preheat the cell.

Figure 6:
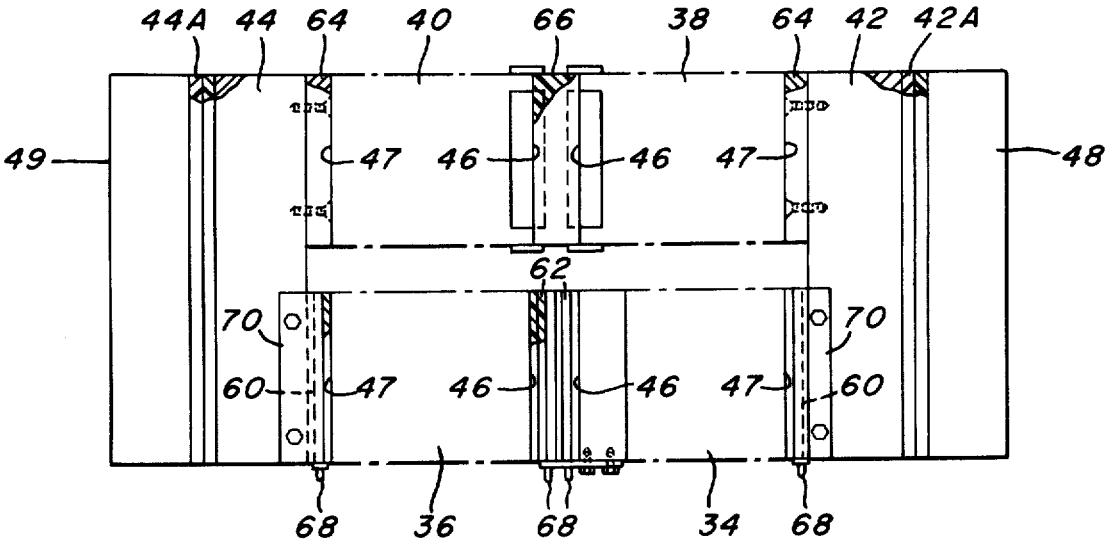
FIG. 6 is a plan view of the switch of FIGS. 4 and 5.
Figure 5:
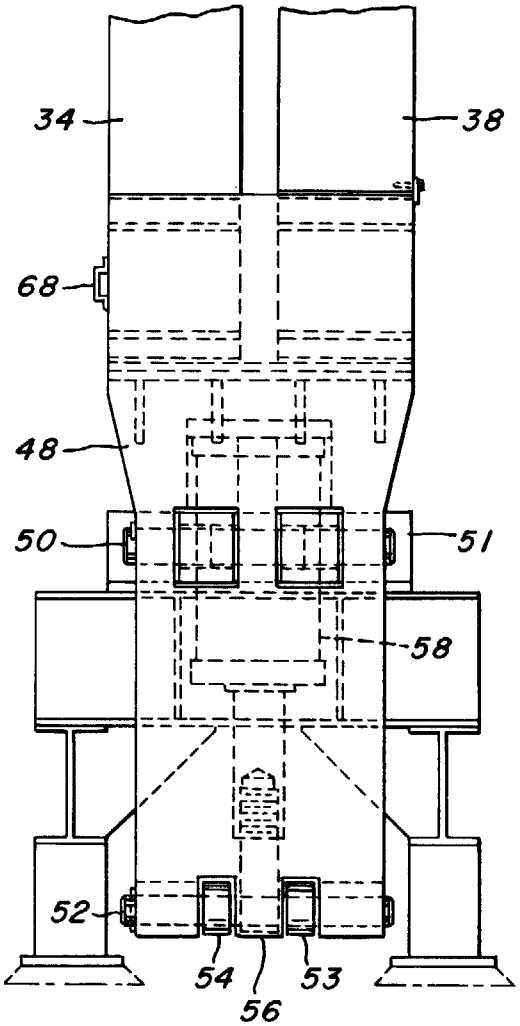
FIG. 5 is a side elevation view of the structure of FIG. 4.
Figure 4:
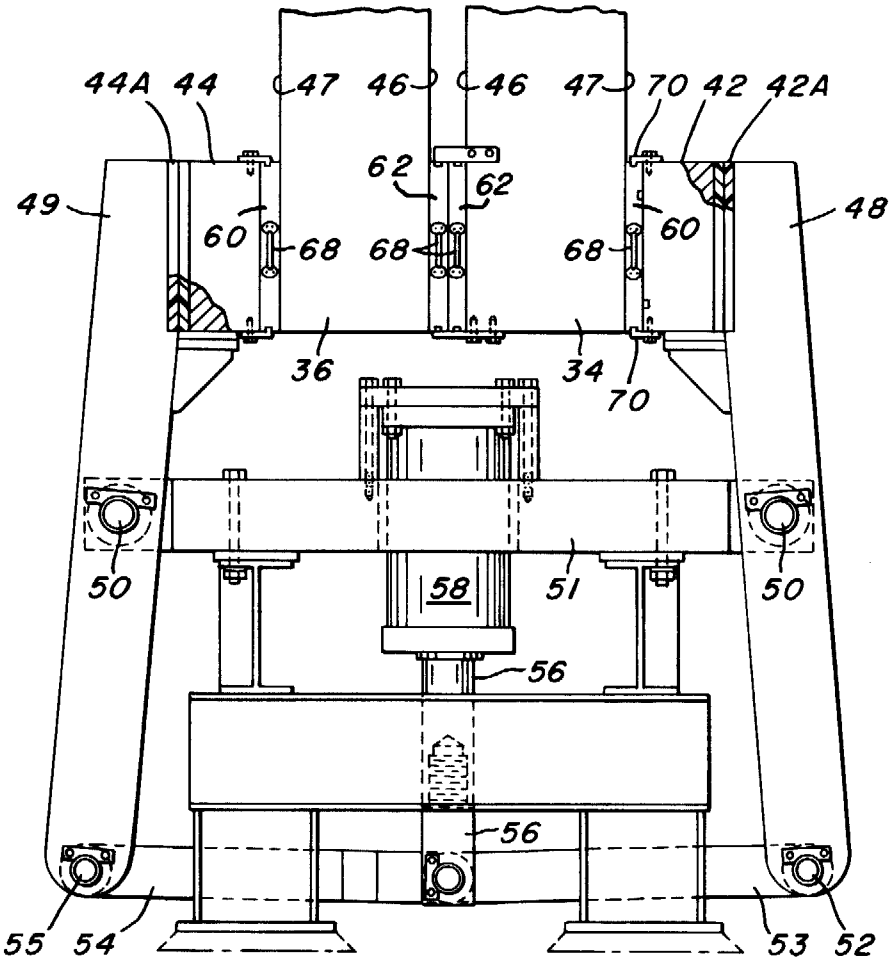
FIG. 4 is a front elevation view of a switching structure made in accordance with the principles of the present invention.

FIGS. 4 to 6 of the drawings show a preferred structural embodiment of the invention the invention being particularly suitable for switching large amounts of current, such as employed in electrolytic cells for the production of metal, though the invention is not limited thereto. In FIGS. 4 to 6, the ends of four large rectangular (in cross section) bus conductors 34, 36, 38 and 40 are shown located between two, large, opposed conductor switch members 42 and 44, the buses being spaced apart from each other, and having parallel inwardly facing planar sides 46 and outwardly facing planar sides 47. As indicated above, buses 34, 36, 38 and 40 of FIGS. 4 to 6 correspond to the line connections extending between switch 10, cell 12 and power supply 14 in FIG. 1, and are so labelled in FIG. 1. For purposes of discussion, buses 34 and 36 may be termed load conductors or buses, these buses being connected only between the load (electrodes 16 and 18) and the switch 10, while buses 38 and 40 can be termed source conductors or buses, since they remain in permanent connection with power source 14.

As shown in FIGS. 4 to 6, switch members 42 and 44 are suitable physically attached to the upper ends of large, elongated clamp arms 48 and 49, and extend along the outwardly facing sides 47 of the buses, as best seen in FIGS. 5 and 6. If the clamp arms are metal structures, the switch must be insulated from the arms by insulating spacers or plates 42A and 44A. The arms 48 and 49, which extend in a generally vertical direction are shown respectively pivotally connected to the ends of a fixed, horizontally extending, beam 51 by large, elongated pins 50 at locations near the midpoint of each arm, as best seen in FIG. 4. In addition, the lower end of vertical arm 46 is pivotally connected to one end of a horizontal arm 53 by a large, elongated pin 52, while vertical arm 48 is pivotally connected to one end of a second horizontal arm 54 by a similar pin 55. From the vertical arms 48 and 49, horizontal arms 53 and 54 extend inwardly to the lower end and of a shaft 56, which shaft is connected to a large air or hydraulic cylinder 58 located beneath the buses.

The above structure, as thus far described, can be mounted on a suitable support or foundation structure, such as shown in FIGS. 4 and 5 of the drawings.

Between the inwardly facing side of the switch members 42 and 44 and their associated buses 34 and 36 are located either an electrically conductive plate member 60, as shown in FIGS. 4 and 6, or, an electrically insulative plate member 62, as discussed hereinafter. With the conductive members located in the manner of FIGS. 4 and 6, insulating plates are located between load buses 34 and 36.

Since plates 60 or 62 require a space for their accommodation between the sides 47 of load buses 34 and 36 and the faces of switch members 42 and 44, a similar space is required between the switch members and source buses 38 and 40, if the sides 47 of buses 34 and 38, and of buses 36 and 40 lie in substantially the same planes. For this reason conductive spacers 64 are shown respectively attached to the faces of switch members 42 and 44 opposite buses 38 and 40.

Similarly, as seen in FIG. 6, between the inward faces 46 of source buses 38 and 40 is disposed, and suitably secured therein, an insulating member or spacer 66. Spacer 66 maintans the space between these two buses and thus maintains their electrical insulation from one another when the clamp arms are moved to force switch members 42 and 44 against the sides of the buses.

As indicated in FIG. 6, the length of the plates 60 and 62 correspond to the depth of buses 34 and 36; similarly the width of any two of the plate members is the same or close to that of spacer 66 located between buses 38 and 40. In addition, the length of switch members 42 and 44 and the width of arms 48 and 49 correspond to the width of bus pairs 34, 38, and 36, 40, as best seen in FIGS. 5 and 6. Further, each plate member is preferably provided with a handle 68, such handles permitting a workman to conveniently grasp each plate in a manual process of changing the mode of the switch of FIGS. 4 to 6, presently to be explained.

In the operation of the structure of FIGS. 4 to 6, the clamp arms 48 and 49 are moved away from the sides 47 of the buses by energization of cylinder 58, the shaft 56 moving in an upward direction to pull horizontal arms 53 and 54 in an upward direction. This pulls the lower ends of arms 48 and 49 inwardly about pivot pins 50 which moves switch members 42 and 44 away from the sides of the buses and removes clamping pressure on the buses and spacer 66. Then, to operate cell 12, for example, in a metal producing manner, conductive plates 60 are secured to the face portion of switch members 42 and 44 opposite buses 34 and 36, as shown in FIGS. 4 and 6, and insulating plates 62 are inserted between load buses 34 and 36, as shown. This is accomplished manually by simply securing plates 60 to the faces of the switch members via suitable securing means, such as plate-like structures 70 fastened to the upper and lower surfaces of the switch members, as shown in FIGS. 4 and 6, and sliding plates 62 between load buses 34 and 36. Plates 62 can be secured in place by plate fastening means 72, as shown in FIG. 4.

With plates 60 and 62 so disposed, cylinder 58 is now operated to pivot clamp arms in the direction of the buses, which forces switch members 42 and 44, with conductor plates 60 and 64, against the outside faces (47) of the buses, and locks the clamp arms in place. The arm and pivot mechanism, as described above, provides a compound toggle and pivot mechanism that locks the clamp arms in place when they are closed on the buses without the need of fluid pressure to cylinder 58. Further, the mechanical advantage of the clamp arms is such that substantial pressure is applied against the buses to assure good electrical contact between switch members 42 and 44, plates 60 and 64 and the sides 47 of the buses for directing large current flows across the contacting surfaces.

Thus, with the arrangement shown in FIGS. 4 and 6, and the operation of the toggle mechanism, as just described, load busses 34 and 36 and source buses 38 and 40 are respectively electrically connected together to place a source of current, such as 14 in FIG. 1, across a load, suc as cell 12 in FIG. 1.

If and/or when it is desired to change the current carrying mode of the switch of FIGS. 4 to 6, for the purpose of placing cell 12 in a stand-by condition, for example, or for the purpose of heating the cell to a predetermined temperature before the cell is placed in operation, cylinder 58 is operated to open clamp arms 48 and 49 in the manner indicated earlier. The plate pairs 60 and 62 are now conveniently manually removed from their present respective locations, and reversed, such that the insulating plates 62 are now secured to the faces of switch members 42 and 44 and conductor plates 60 located between load buses 34 and 36. Cylinder 58 is again reactivated to close and lock the clamp arms against the sides of the buses. The switch members 42 and 44 are now insulated from the load buses by plates 62 so that the load and source bus pairs are insulated and isolated from each other. The loaded buses themselves, however, are now directly shorted together by conductive plates 60 so that the anodes and cathodes of cell 12, for example, are connected in series with power supply 14, as indicated schematically in FIG. 3.

In the schematic rendering of switch 10 in FIG. 1, plates 60 (in the shorting position between buses 34 and 36) correspond to the center conductor 24 that is moved to engage terminals 28 and 30, as described earlier. With the electrodes of the cell connected in series with a source of power, the electrical resistance of the electrodes is sufficient to heat and maintain the heat in the interior of the cell.

While the invention has been described in terms of preferred embodiments, the claims appended hereto are intended to encompass all embodiments which fall within the spirit of the invention.

Haing thus described my invention and certain embodiments thereof, I claim:

1. Structure for changing the path of current flow through an electrical load connected to a source of electrical current by four fixed conductors physically disposed in close but spaced relationship to each other, two of the four conductors being hereinafter referred to as source conductors and two as load conductors, a movable, electrically conductive switch member located on one side of one source and one load conductor for electrically connecting the one load conductor and the one source conductor together, a second movable electrically conductive switch member located on one side of the other two load and source conductors for electrically connecting the same together, two electrically insulative members for physical disposal in location between the load conductors and, two electrically conductive members for physical disposal in respective locations between the switc members and their associated load conductors, the electrically conductive members being effective to respectively electrically connect together the switch members and their associated load conductors when the switch members are moved to engage the source conductors and the conductive members.

2. The structure of claim 1 in which the insulative members are each provided with a handle, and are physically removable from the location between the load conductors, and the conductive members are physically removable from their respective locations between the switch members and their associated load conductors.

3. The structure of claim 2 in which the two insulative members are respectively disposable between the switch members and their associated load conductors to insulate the load conductors from the switch members when the switch members are moved to engage the source conductors, and the conductive members are disposable between the load conductors to electrically connect the same together.

4. The structure of claim 1 including two, elongated clamp arms respectively associated with the two switch members, and a compound toggle arrangement mechanically associated with the clamp arms, the clamp arms and toggle arrangement being adapted to move the switch members into and out of engagement with the load and source conductors, and to lock the clamp arms in engagement with the load and source conductors.

5. Apparatus for changing the operation of an electrolytic cell having at least one anode and one cathode, and a source of electrical current ordinarily directly connected to the anode and to the cathode at two, spaced apart locations on the anode and cathode for electrolytic operation of the cell, the apparatus comprising means for disconnecting one of the locations on the anode and cathode from the source of electrical current, and means for connecting the disconnected locations of the anode and cathode directly together such that the path of current flow to and from the source of electrical current is limited to serial flow through the anode and cathode, the electrical resistance of the anode and cathode to the flow of electrical current therethrough being effective to heat the cell.

* * * * *